US006848676B2

(12) United States Patent
Sax et al.

(10) Patent No.: US 6,848,676 B2
(45) Date of Patent: Feb. 1, 2005

(54) FENCE CONSTRUCTION SYSTEM FOR BUILDING A FENCE WITH A WALL APPEARANCE AND CHARACTERISTICS AND METHOD FOR BUILDING SUCH A FENCE

(75) Inventors: Edward Sax, 1030 Arabian Dr., Loxahatchee, FL (US) 33470; Paul Dearaujo, Royal Palm Beach, FL (US)

(73) Assignee: Edward Sax, Loxahatchee, FL (US)

( * ) Notice: Subject to any disclaimer, the term of this patent is extended or adjusted under 35 U.S.C. 154(b) by 0 days.

(21) Appl. No.: 10/076,978

(22) Filed: Feb. 15, 2002

(65) Prior Publication Data

US 2003/0155566 A1 Aug. 21, 2003

(51) Int. Cl.[7] ..... E04H 17/014; B21F 27/020

(52) U.S. Cl. ..... 256/24; 256/32; 256/37; 29/460; 29/897.32; 52/223.6; 52/223.14

(58) Field of Search ..... 256/19, 32, 33, 256/37, 40, 41, 45, 1, 24; 52/222, 223.1, 223.6, 223.14; 428/294.7; 29/460, 464, 897.3, 897.32

(56) References Cited

U.S. PATENT DOCUMENTS

| | | | | | |
|---|---|---|---|---|---|
| 167,973 | A | | 9/1875 | Ballentine | |
| 355,135 | A | * | 12/1886 | Bunch | 256/37 X |
| 485,304 | A | * | 11/1892 | Spillinger | 256/35 |
| 520,137 | A | | 5/1894 | Deslauriers | |
| 1,030,411 | A | * | 6/1912 | Larsen | 256/32 |
| 3,086,273 | A | * | 4/1963 | Welborn | 52/223.14 X |
| 3,869,530 | A | | 3/1975 | Williams | |
| 4,029,037 | A | * | 6/1977 | Hogan | |
| 4,031,285 | A | * | 6/1977 | Miller et al. | |
| 4,365,451 | A | | 12/1982 | Nelson | |
| 4,366,657 | A | | 1/1983 | Hopman | |
| 4,597,925 | A | | 7/1986 | Loggy | |
| 4,903,446 | A | * | 2/1990 | Richards et al. | 52/223.6 |
| 5,501,057 | A | | 3/1996 | Dawson | |
| 5,894,704 | A | | 4/1999 | Watkins | |
| 6,299,679 | B1 | * | 10/2001 | Montoya | 106/724 |
| 6,355,333 | B1 | * | 3/2002 | Waggoner et al. | 428/174 |

* cited by examiner

*Primary Examiner*—Daniel P. Stodola
*Assistant Examiner*—Ryan M. Flandro
(74) *Attorney, Agent, or Firm*—Laurence A. Greenberg; Werner H. Stemer; Ralph E. Locher

(57) ABSTRACT

A fence construction system and a method for building such a fence are provided. The fence looks like a wall and has wall characteristics, such as a post-tension condition, but is much less expensive and easier to build. A ratcheting system or tensioning system is used to tension the tensile wires which are then secured to the fence posts. A wire lath is applied to the tensile wires and coating material is then applied to the surface of the wire lath. After forming the fence construction, the tensile wires are released and the ratcheting posts are removed. The fence construction system can be used to build a fence portion of up to 300 feet long at one time.

38 Claims, 4 Drawing Sheets

FENCE CONSTRUCTION SYSTEM FOR BUILDING A FENCE WITH A WALL APPEARANCE AND CHARACTERISTICS AND METHOD FOR BUILDING SUCH A FENCE

BACKGROUND OF THE INVENTION

1. Field of the Invention

The present invention relates to a fence construction system for building a fence and a method for building a fence. More particularly, the invention relates to a fence construction system for building a fence that looks like a wall and a method of using such a fence construction system to build the fence. The fence construction system and method of the present invention are very easy to use and can build fences inexpensively with an elegant wall appearance and additional security.

It is common practice for a homeowner or a land developer to build a fence around his or her property to separate the property from neighbor's properties and provide the house with a certain extent of privacy and security. However, a regular fence often cannot prevent the passersby from looking through the fence and cannot provide satisfactory appearance and security. In order to protect privacy, to provide higher security and to improve the appearance of the house, some homeowners and land developers choose to build a wall.

However, it is very expensive and time consuming to build a wall. Therefore, not everybody can afford to build a wall. The people who cannot afford a wall and who are not satisfied with a regular fence do not have any other choice.

Therefore, there is a need for a new fence construction system and a method for building such a fence that has a wall appearance and characteristics but is much less expensive and easier to build.

2. Description of Related Prior Art

Williams (U.S. Pat. No. 3,869,530) teaches a procedure for constructing circular concrete walls in sectors. Tension is applied to peripheral reinforcing rods in the sectors to a desired degree of pre-stress after the concrete sets. The pre-stressed reinforcing rods are then grouted through the use of hollow rods and vented couplings.

Dawson (U.S. Pat. No. 5,501,057) teaches a unit masonry fence and a method for its installation. The unit masonry fence has footings, support posts extending upwardly from the footings and prefabricated fence panels mounted over the support posts.

Loggy (U.S. Pat. No. 4,597,925) teaches a method of constructing a modular reinforced concrete building with roof metal lath.

Ballentine (U.S. Pat. No. 167,973) teaches a wall construction of buildings in which a composition for artificial stone is filled in the space between strips on both sides of the posts. No pre-stress or post tensioning is used in the construction.

Deslauriers (U.S. Pat. No. 520,137) teaches a fireproof and slow burning building wall with a sheet metal covering. Metallic studs, horizontal angle bars and wire laths underneath the bars constitute a metallic framework. No pre-stress or post tensioning is used in the construction.

Watkins (U.S. Pat. No. 5,894,704) teaches a bearing wall construction process without removable forms wherein a reinforcing screen is encased within concrete during a concrete blowing step.

Nelson (U.S. Pat. No. 4,365,451) teaches a poured adobe building construction and a method for forming the same.

Hopman (U.S. Pat. No. 4,366,657) teaches a method and a form for mechanically pouring adobe structures.

All of the above-mentioned references relate basically to the construction of walls for buildings, which require high supporting ability. These wall constructions are basically formed by pouring concrete, adobe or other material within forms or formed by prefabricated bricks or stones, which are very complicated and are very expensive to construct. None of them is constructed specifically for the purpose of building a fence with a wall appearance and characteristics at low cost.

SUMMARY OF THE INVENTION

It is accordingly an object of the present invention to provide a fence construction system for building a fence having wall appearance and characteristics, and a method for building such a fence, which overcome the deficiencies of both the conventional fence and the conventional wall.

Another object of the present invention is to provide a fence construction system and a method for building a fence, which are easy to use and can substantially lower the cost of such structures.

In one aspect, the present invention relates to a method for constructing a fence with a wall appearance and characteristics, comprising the steps of:

erecting a plurality of fence posts including two end fence posts;

erecting two temporary ratcheting posts beyond the two end fence posts with a plurality of ratchets fixed an the ratcheting posts;

stringing a plurality of high-tension tensile wires between the temporary ratcheting posts;

tensioning the high-tension tensile wires with the ratchets;

securing the high-tension tensile wires to the fence posts;

securing wire lath to the pre-stressed high-tension tensile wires;

applying fence coating material to the wire lath;

cutting the high-tension tensile wires beyond the end fence posts; and removing the temporary ratcheting posts.

In accordance with another feature of the invention, the method for constructing a fence with a wall appearance and characteristics further comprises:

marking fence layout and post locations according to a survey;

digging post holes in the marked post locations;

placing the fence posts in the post holes;

plumbing and aligning the fence posts; and securing the fence posts in the post holes by concrete.

In accordance with another feature of the invention, the post holes are preferably 8"×10" in diameter and 24" in depth.

In accordance with another feature of the invention, the method for constructing a fence with a wall appearance and characteristics further comprises touching up the end fence posts where the high-tension tensile wires were cut.

In accordance with another feature of the invention, the method for constructing a fence with a wall appearance and characteristics further comprises painting with a final coat to the surface of the fence coating material.

In accordance with another feature of the invention, the size and number of the fence posts are determined by fence dimension, configuration, soil condition and local construction regulations.

In accordance with another feature of the invention, the fence posts are secured in the post holes by 2500 psi concrete.

In accordance with another feature of the invention, the fence posts are secured in the post holes by pulling the fence posts a distance upwards before the concrete sets.

In accordance with another feature of the invention, the high-tension tensile wires are strung between the temporary ratcheting posts at one side of the fence posts.

In accordance with another feature of the invention, the high-tension tensile wires are strung between the temporary ratcheting posts at both sides of the fence posts.

In accordance with another feature of the invention, the high-tension tensile wires are spaced at about an 8–12 inch vertical separation.

In accordance with another feature of the invention, the high-tension tensile wires are tensioned with a torque of about 150–250 LBS per square inch.

In accordance with another feature of the invention, the high-tension tensile wires are secured to the fence posts with fasteners such as staples and clips.

In accordance with another feature of the invention, the wire lath is secured to the high-tension tensile wires with fastener clips.

In accordance with an additional feature of the invention, the step of applying fence coating material to the wire lath is performed by:

applying a scratch coat to the wire lath;

applying a brown coat to the surface of the scratch coat; and applying a texture coat to the surface of the brown coat.

In accordance with another feature of the invention, the method for constructing a fence with a wall appearance and characteristics further comprises securing the wire lath to the fence posts.

In another aspect, the present invention relates to a fence construction system, comprising:

a plurality of fence posts;

at least two temporary ratcheting posts, one of the ratcheting posts having a plurality of holes formed therein;

a plurality of ratchets secured in at least some of the holes;

a plurality of high-tension tensile wires running between the temporary ratcheting posts and secured to the plurality of fence posts; and a wire lath secured to the plurality of high-tension tensile wires.

In accordance with another feature of the invention, the high-tension tensile wires are about 12–18 gauge.

In accordance with another feature of the invention, the wire lath is 2.8–3.4 galvanized metal or plastic.

In accordance with an additional feature of the invention, the fence construction system further comprises a fence coating applied to the wire lath.

In accordance with another feature of the invention, the fence coating includes a scratch coat applied to the wire lath, a brown coat applied to the surface of the scratch coat and a texture coat applied to the surface of the brown coat.

In accordance with another feature of the invention, the scratch coat is a Portland cement mixture with polymers, various fiber particles and selected sizes of aggregate.

In accordance with another feature of the invention, the brown coat is of the same mixture as the scratch coat.

In accordance with another feature of the invention, both the scratch coat and the brown coat have the thickness of about ⅜ inch.

In accordance with an additional feature of the invention, the fence construction system further comprises a paint applied on the fence coating.

In accordance with another feature of the invention, the paint is a prime coat or a color coat.

In accordance with an additional feature of the invention, the fence construction system further comprises a pre-constructed non-structural decoration column.

In a further aspect, the present invention relates to a fence comprising:

a plurality of fence posts;

a plurality of high-tension tensile wires secured to the plurality of fence posts;

a wire lath secured to the plurality of high-tension tensile wires; and a fence coating applied to the wire lath.

In accordance with another feature of the invention, the fence further comprises a paint applied to the surface of the fence coating.

Additional objects and advantages of the invention will be set forth in part in the description which follows, and in part will be clear from the description, or may be learned by practice of the invention. The advantages of the invention will be realized and attained by the elements and combinations particularly pointed out in the appended claims. It is to be understood that both the foregoing general description and the following detailed description are exemplary and explanatory only and are not restrictive of the invention, as claimed.

DETAILED DESCRIPTION OF THE PREFERRED EMBODIMENTS

The present invention may be understood more readily by reference to the following detailed description of preferred embodiments of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an" and "the" include plural referents unless the context clearly dictates otherwise.

The present invention will now be described in detail with reference to the accompanying drawings.

Figure 1A:
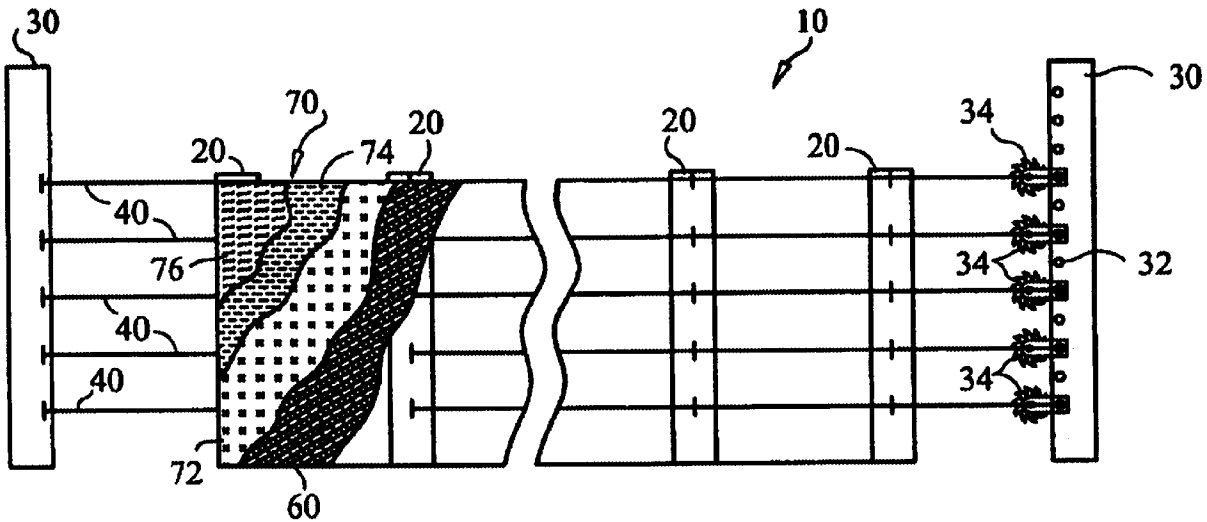
FIG. 1A is a diagrammatic front elevational view of the fence construction system with a partially constructed fence according to the present invention.
Figure 6:
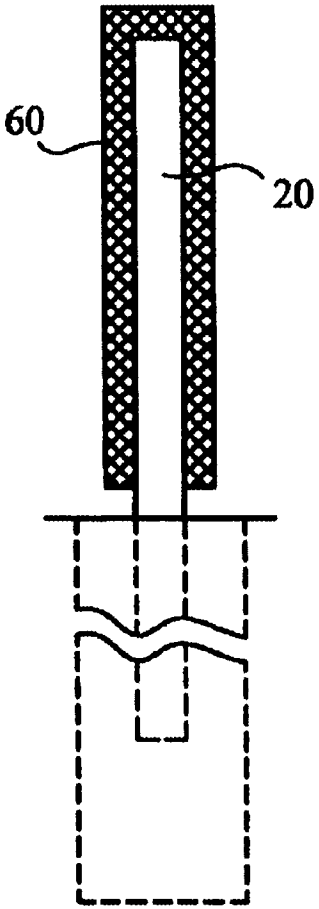
FIG. 6 is a cross-sectional view taken along a line B—B of FIG. 4, in the direction of the arrows.
Figure 5:
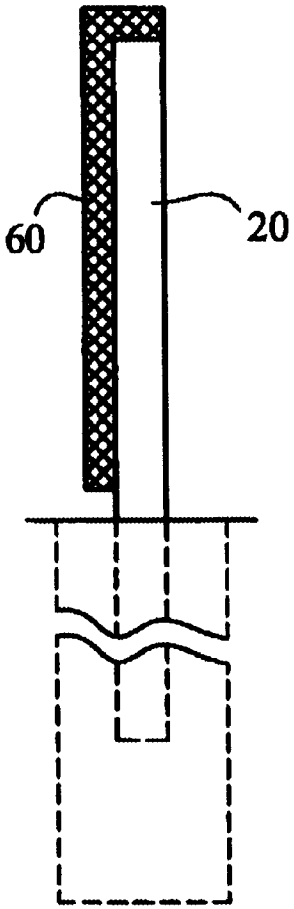
FIG. 5 is a cross-sectional view taken along a line A—A of FIG. 3, in the direction of the arrows.

Referring to the drawings and initially to FIG. 1, there is diagrammatically shown a representative fence construction system generally designated by the reference numeral 10. Before beginning the construction of the fence, a survey must be conducted to decide the size, the height and the configuration of the fence, according to which the fence layout and post locations are then decided and marked. Post holes (shown in FIGS. 5–6) are then dug at the post locations. The post holes can be of any size big enough for the fence posts, but are preferably to be about 8 inches×10 inches in diameter and about 24 inches in depth. Fence posts 20 are then placed into the post holes. The number and the size of the fence posts and the distance between the fence posts are determined by the dimensions and configuration of the fence. The fence posts are then plumbed, aligned to the layout of the fence and secured with concrete, e.g., 2500 psi concrete, in the post holes. As is shown in FIGS. 5 and 6, depending on the soil, the post holes can be deeper than the embedment of the fence posts to avoid the contact of the bottom of the fence posts with the soil. This can be done by pulling the fence posts a distance upwards before the concrete sets.

Next, two temporary ratcheting posts (or tensioning posts) 30 are installed beyond two end fence posts. One of the ratcheting posts has a plurality of holes 32 on two opposite side faces (only one side is shown) of the ratcheting post. The holes are used as fastening locations for the assembly of ratchets or tensioners 34. The number of ratchets or tensioners 34 depends on the number of high-tension tensile wires to be used, which in turn depends on the customers' requirement and the local government regulations. A plurality of high-tension tensile wires 40 are strung between the two ratcheting posts 30 at one side or both sides of the fence posts 20. One end of each wire is fixed to one ratcheting post and the other end is attached to a ratchet on the other ratcheting post. The high-tension tensile wires 40 are about 12–18 gauge and spaced about 8–12 inches apart vertically.

Figure 2:
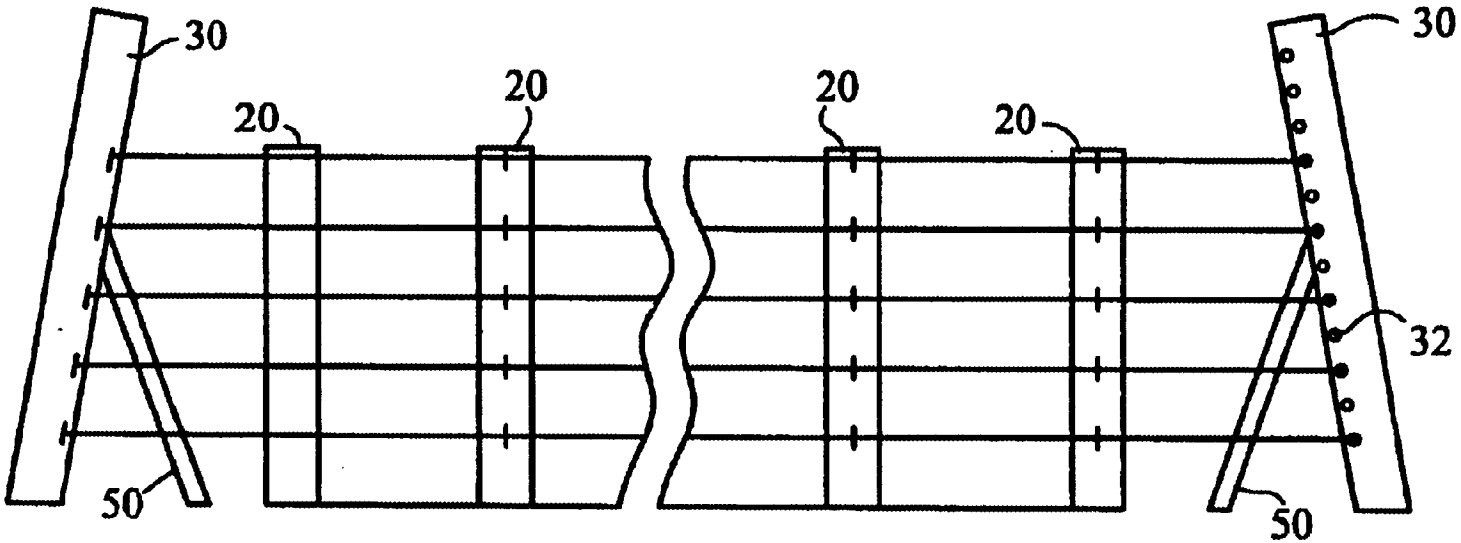
FIG. 2 is a view similar to FIG. 1, showing the temporary ratcheting posts in their tilted positions after the tensioning of the high-tension tensile wires.

The high-tension tensile wires 40 (e.g. A102 Superlife 12 HT wire) are tensioned by turning the ratchets 34 (e.g. distributed by MAX-FLEX company) clockwise to a torque of about 150–250 LBS per square inch and then are secured to the fence posts 20 by staples, clips or any other fasteners. As is shown in FIG. 2, after applying the tension to the high-tension tensile wires 40, the ratcheting posts 30 might incline towards each other. In order to secure the ratcheting posts 30 during the construction, additional supporting posts 50 can be used.

Figure 3:
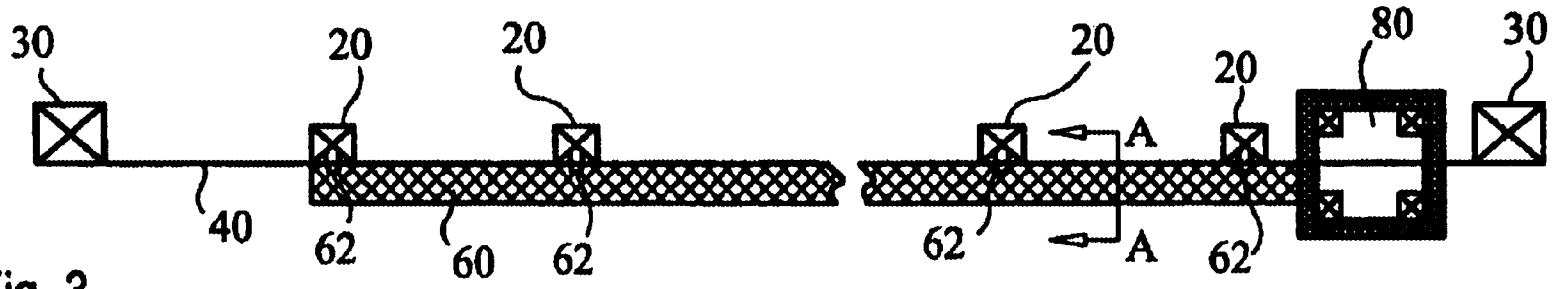
FIG. 3 is a top-plan view of the fence construction system of FIG. 1, showing a wire lath applied at one side of the fence posts and an additional pre-constructed non-structural decoration column.
Figure 4:
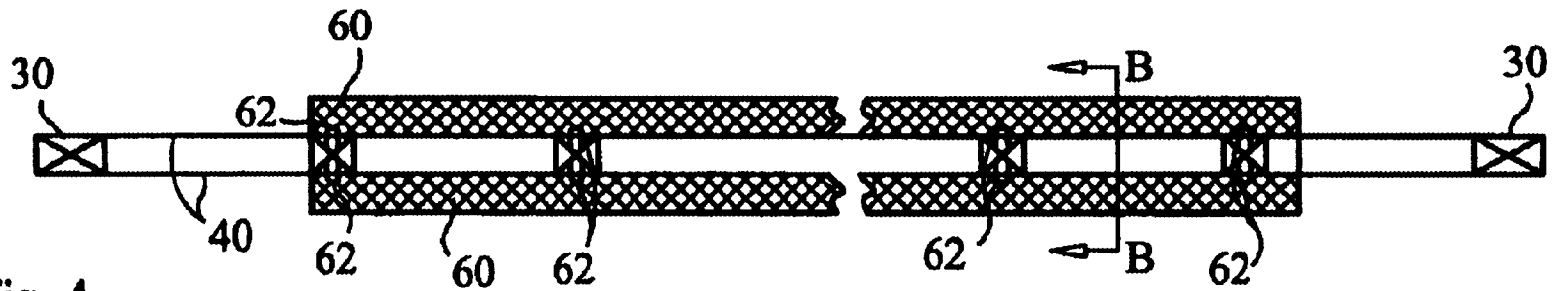
FIG. 4 is a top-plan view of the fence construction of FIG. 1, showing wire laths applied at both sides of the fence posts.

As is shown in FIGS. 1, 3 and 4, wire lath(s) 60 can be secured to one or both opposite sides of the fence posts 20 and to the tensioned tensile wires 40 by clips or any other fasteners 62 (e.g. A300 Spring clip tighteners). The wire laths can be galvanized metal or plastic and are about 2.8–3.4 gauge. Fence coating material 70 is then applied to the surface of the wire lath. The WONDERTEC™ coating material produced by Wondertec of America, Inc. is especially suitable for building the fence construction according to the present invention. Alternatively, other coating material (such as ASTM A 854–94 with a minimum strength requirement of 1800 PSI) can also be used. Typically, the coating material 70 includes three coating layers 72, 74 and 76 (see FIG. 1). First, a scratch coat 72 (e.g. Portland cement mixture with polymers, various fiber particles and selected sizes of aggregate) is applied with potable water to the wire lath. Then a brown coat 74 of the same mixture is applied to the surface of the scratch coat. At last a finish coat 76 (e.g. texture coat of choice) is applied to the surface of the brown coat. The thickness of the scratch coat layer and the brown coat layer are about ⅜ inch.

Figure 1B:
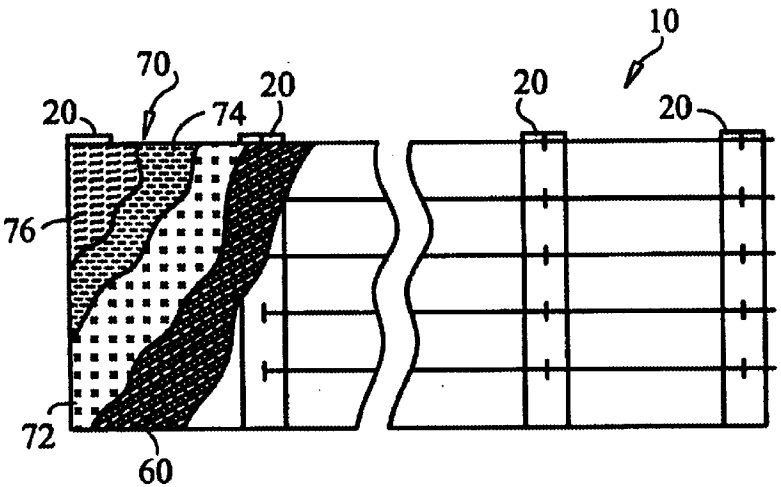
FIG. 1B is a diagrammatic front elevational view of the fence construction system with a partially constructed fence according to the present invention, after the high-tension tensile wires are cut.

As shown in FIG. 1B, after the forming of the coating, the tensioned high-tension tensile wires 40 are cut outside the end fence posts to create a post-tension condition in the fence construction. The temporary ratcheting posts 30 are then removed and the end fence posts are touched up at where the high-tension tensile wires were cut. The thus-formed fence construction can then be painted with a prime coat or a color coat according to choice.

To further improve the appearance of the fence, wire lath and coating can also be applied on the top surface of the fence (as shown in FIGS. 5 and 6). Pre-constructed non-structural columns 80 (as shown in FIG. 3), which are made of wooden vertical posts in the corners, horizontal spaces therebetween and wire lath and stucco, can be used to provide decoration at the corners or gate of the fence. As shown in FIGS. 5 and 6, the bottom of the fence is unsupported by the ground.

The fence construction system according to the present invention can be used to build a fence portion of up to 300 feet long at one time.

Other embodiments of the invention will be apparent to those skilled in the art from consideration of the specification and practice of the invention disclosed herein. It is intended that the specification and examples be considered as exemplary only.

We claim:

1. An intermediate fence construction system, comprising:

a plurality of fence posts including end fence posts;

a ratcheting system including at least two temporary ratcheting posts, at least one of said ratcheting posts having a plurality of fastening locations;

a plurality of ratchets secured at least at some of said fastening locations;

a plurality of high-tension tensile wires running between said temporary ratcheting posts and secured to said plurality of fence posts, at least one end of each of said high-tension tensile wires being connected to a respective one of said ratchets, said high-tension tensile wires being tensioned to a pre-determined tension by actuating said ratchets;

a wire lath secured to said plurality of tensioned high-tension tensile wires and said fence posts; and a fence coating applied to said wire lath; wherein, when said tensioned high-tension tensile wires are cut between said end fence posts and said ratcheting posts, said wire lath and said fence coat are compressed.

2. The intermediate fence construction system according to claim 1, wherein said high-tension tensile wires are galvanized and said wire lath is one of galvanized metal and plastic.

3. The intermediate fence construction system according to claim 1, wherein said fence coating includes a scratch coat applied to said wire lath, a brown coat applied to said scratch coat and a finish coat applied to said brown coat.

4. The intermediate fence construction system according to claim 3, wherein said scratch coat is a Portland cement mixture with polymers, various fiber particles and selected sizes of aggregate.

5. The intermediate fence construction system according to claim 3, wherein said brown coat is of the same mixture as said scratch coat.

6. The intermediate fence construction system according to claim 3, wherein each of said scratch coat and said brown coat is about ⅜".

7. The intermediate fence construction system according to claim 1, further comprising a paint applied on said fence coating.

8. The intermediate fence construction system according to claim 7, wherein said paint is one of a prime coat and a color coat.

9. The intermediate fence construction system according to claim 1, further comprising a pre-constructed non-structural decoration column.

10. The intermediate fence construction system according to claim 1, further comprising at least one supporting post for supporting at least one of said ratcheting posts.

11. The intermediate fence construction system according to claim 1, wherein said wire. lath defines an unsupported fence bottom.

12. The intermediate fence construction system according to claim 1, wherein said wire lath is directly secured to said plurality of tensioned high-tension tensile wires and said fence posts.

13. A fence comprising:

a plurality of fence posts;

a plurality of high-tension tensile wires secured to said plurality of fence posts, said high-tension tensile wires being tensioned to a pre-determined tension and having free ends;

a wire lath secured to said plurality of tensioned high-tension tensile wires and said fence posts and being compressed by said tensioned high-tension tensile wires; and a fence coating applied to said wire lath, said high-tension tensile wires compressing said fence coating together with said wire lath.

14. The fence according to claim 13, further comprising a paint applied to the surface of said fence coating.

15. The fence according to claim 13, wherein said wire lath defines an unsupported fence bottom.

16. The fence according to claim 13, wherein said fence posts include end fence posts and said high-tension tensile wires are unattached beyond said end fence posts.

17. The fence according to claim 13, wherein said wire lath is directly secured to said plurality of tensioned high-tension tensile wires and said fence posts.

18. A method for constructing the fence set forth in claim 13 with a wall appearance and characteristics, which comprises the steps of:

erecting a plurality of fence posts including two end fence posts;

erecting two temporary ratcheting posts beyond the two end fence posts with a plurality of ratchets fixed on the ratcheting posts;

stringing a plurality of high-tension tensile wires between the temporary ratcheting posts;

tensioning the high-tension tensile wires with the ratchets;

securing the high-tension tensile wires to the fence posts;

securing wire lath to the pre-stressed high-tension tensile wires;

applying fence coating material to the wire lath;

cutting the high-tension tensile wires beyond the end fence posts; and removing the temporary ratcheting posts.

19. The method according to claim 18, which further comprises:

marking fence layout and post locations according to a survey;

digging post holes in the marked post locations;

placing the fence posts in the post holes;

plumbing and aligning the fence posts; and securing the fence posts in the post holes by concrete.

20. The method according to claim 19, which further comprises digging the post holes with an 8"×10" diameter and a 24" depth.

21. The method according to claim 18, which further comprises touching up the end fence posts where the high-tension tensile wires were cut.

22. The method according to claim 18, which further comprises painting with a final coat to the surface of the fence coating material.

23. The method according to claim 18, which further comprises determining the size and number of the fence posts by fence dimension, configuration, soil condition and local construction regulations.

24. The method according to claim 18, which further comprises securing the fence posts in the postholes by 2500 psi concrete.

25. The method according to claim 18, which further comprises securing the fence posts in the postholes by pulling the fence posts a distance upwards before the concrete sets.

26. The method according to claim 18, which further comprises stringing the high-tension tensile wires between the temporary ratcheting posts at one side of the fence posts.

27. The method according to claim 18, which further comprises stringing the high-tension tensile wires between the temporary ratcheting posts at both sides of the fence posts.

28. The method according to claim 18, which further comprises stringing the high-tension tensile wires spaced at about an 8–12 inch vertical separation.

29. The method according to claim 18, which further comprises tensioning the high-tension tensile wires with a torque of about 150–250 LBS per square inch.

30. The method according to claim 18, which further comprises securing the wire lath to the high-tension tensile wires with fastener clips.

31. The method according to claim 18, which further comprises securing the wire lath to the fence posts.

32. The method according to claim 18, which further comprises performing the step of applying fence coating material to the wire lath by:

applying a scratch coat to the wire lath;

applying a brown coat to the surface of the scratch coat; and applying a finish coat to the surface of the brown coat.

33. A fence construction system, comprising:

a plurality of fence posts including end fence posts;

a ratcheting system including at least two ratcheting posts, at least one of said ratcheting posts having a plurality of fastening locations;

a plurality of ratchets secured at least at some of said fastening locations;

a plurality of high-tension tensile wires running between said ratcheting posts and secured to said plurality of fence posts, at least one end of each of said high-tension tensile wires being connected to a respective one of said ratchets, said high-tension tensile wires being tensioned to a pre-determined tension by actuating said ratchets;

a wire lath secured to said plurality of tensioned high-tension tensile wires and said fence posts; and a fence coating applied to said wire lath; wherein, when said tensioned high-tension tensile wires are cut between said end fence posts and said ratcheting posts, said wire lath and said fence coating are compressed.

34. An intermediate fence construction system, comprising:

a plurality of fence posts including end fence posts;

a tensioning system including at least two temporary tensioning posts, at least one of said tensioning posts having a plurality of fastening locations;

a plurality of tensioners secured at least at some of said fastening locations;

a plurality of high-tension tensile wires running between said temporary tensioning posts and secured to said plurality of fence posts, at least one end of each of said high-tension tensile wires being connected to a respective one of said tensioners, said high-tension tensile wires being tensioned to a pre-determined tension by actuating said tensioners;

a wire lath secured to said plurality of tensioned high-tension tensile wires and said fence posts; and a fence coating applied to said wire lath; wherein, when said tensioned high-tension tensile wires are cut between said end fence posts and said tensioning post, said wire lath and said fence coating are compressed.

35. The intermediate fence construction system according to claim 34, wherein said wire lath is directly secured to said plurality of tensioned high-tension tensile wires and said fence posts.

36. A fence construction system, comprising:

a plurality of fence posts including end fence posts;

a tensioning system including at least two tensioning posts, at least one of said tensioning posts having a plurality of fastening locations;

a plurality of tensioners secured at least at some of said fastening locations;

a plurality of high-tension tensile wires running between said tensioning posts and secured to said plurality of fence posts, at least one end of each of said high-tension tensile wires being connected to a respective one of said tensioners, said high-tension tensile wires being tensioned to a pre-determined tension by actuating said tensioners;

a wire lath secured to said plurality of tensioned high-tension tensile wires and said fence posts; and a fence coating applied to said wire lath; wherein, when said tensioned high-tension tensile wires are cut between said end fence posts and said tensioning posts, said wire lath and said fence coating are compressed.

37. A method for constructing a fence with a wall appearance and characteristic as set forth in claim 36, which comprises the steps of:

erecting a plurality of fence posts including two end fence posts;

erecting two tensioning posts beyond the two end fence posts with a plurality of tensioners fixed on at least one of the tensioning posts;

stringing a plurality of high-tension tensile wires between the tensioning posts;

tensioning the high-tension tensile wires with the tensioners;

securing the high-tension tensile wires to the fence posts;

securing wire lath to the pre-stressed high-tension tensile wires;

applying fence coating material to the wire lath; and cutting the high-tension tensile wires beyond the end fence posts.

38. The method according to claim 37, which further comprises: removing the tensioning posts.

* * * * *